United States Patent [19]

Moon et al.

[11] Patent Number: 5,039,147

[45] Date of Patent: Aug. 13, 1991

[54] DOORSTAYS

[75] Inventors: Alan Moon; George W. McCrea, 31 Earlswood Road, Belfast, Northern Ireland, BT4 3DZ

[73] Assignee: George Windsor McCrea, Belfast, Northern Ireland

[21] Appl. No.: 382,704

[22] PCT Filed: Oct. 17, 1988

[86] PCT No.: PCT/GB88/00870

§ 371 Date: Aug. 14, 1989

§ 102(e) Date: Aug. 14, 1989

[87] PCT Pub. No.: WO89/03470

PCT Pub. Date: Apr. 20, 1989

[30] Foreign Application Priority Data

Oct. 15, 1987 [GB] United Kingdom ..... 8724164

[51] Int. Cl.[5] ..... E05C 17/30

[52] U.S. Cl. ..... 292/338; 292/762

[58] Field of Search ..... 292/338, 331, 305, 262

[56] References Cited

U.S. PATENT DOCUMENTS

| | | | |
|---|---|---|---|
| 1,695,686 | 12/1928 | Hess | 292/338 |
| 2,760,806 | 8/1956 | Woodard et al. | 292/338 |
| 2,870,281 | 1/1959 | Mitchell | 292/338 |
| 4,019,765 | 4/1977 | Nichols | 292/338 |
| 4,070,049 | 1/1978 | Brewer | 292/338 |
| 4,346,926 | 8/1982 | Lucas | 292/338 |
| 4,358,758 | 11/1982 | Morton | 292/339 X |
| 4,442,427 | 4/1984 | Morton | 292/339 X |

FOREIGN PATENT DOCUMENTS

| | | | |
|---|---|---|---|
| 980928 | 1/1951 | France | 292/338 |
| 469910 | 3/1952 | Italy | 292/338 |
| 2188676 | 3/1986 | United Kingdom | 292/338 |
| 2186909 | 8/1987 | United Kingdom | 292/338 |

*Primary Examiner*—Eric K. Nicholson

*Attorney, Agent, or Firm*—Armstrong, Nikaido, Marmelstein, Kubovcik, & Murray

[57] ABSTRACT

A doorstay comprising a stay having a determined length retraction, and being formed by two members in telescopic relationship. The stay is pivotally mountable at the distal end of one member to a first bracket to be secured to a surface, such as a wall against which the door is openable, and at the distal end of the other member is locatable into a second bracket secured to the inside of the door. The doorstay is provided with an audible or visual warning signal, of both an audible and visual warning signal, actuated when attempt is made from the other side of the door to open the door.

11 Claims, 4 Drawing Sheets

FIG. 4
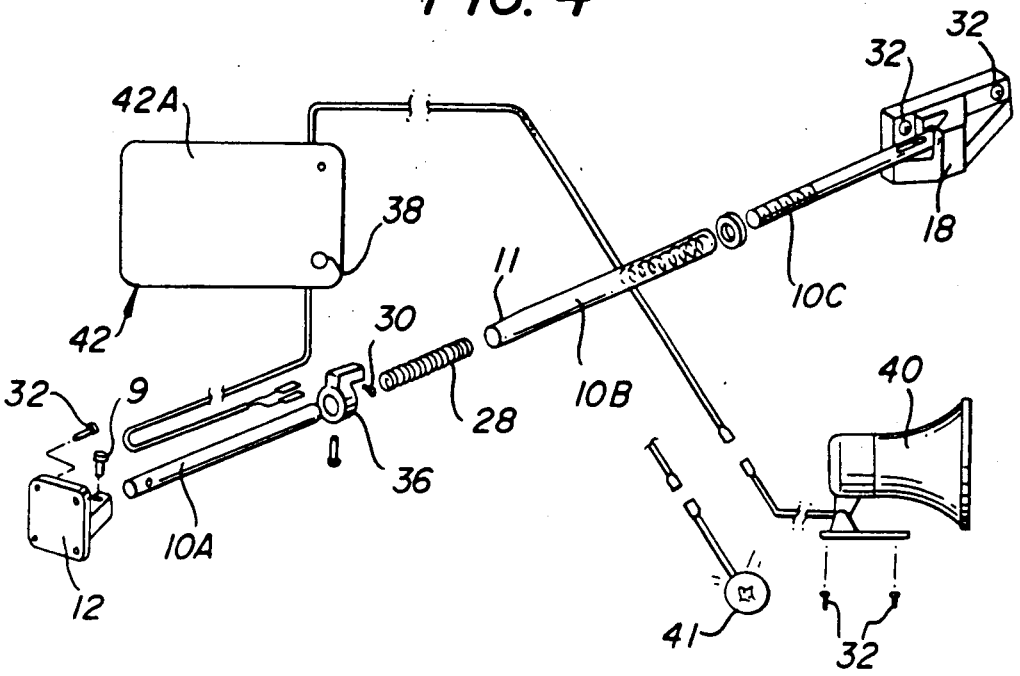
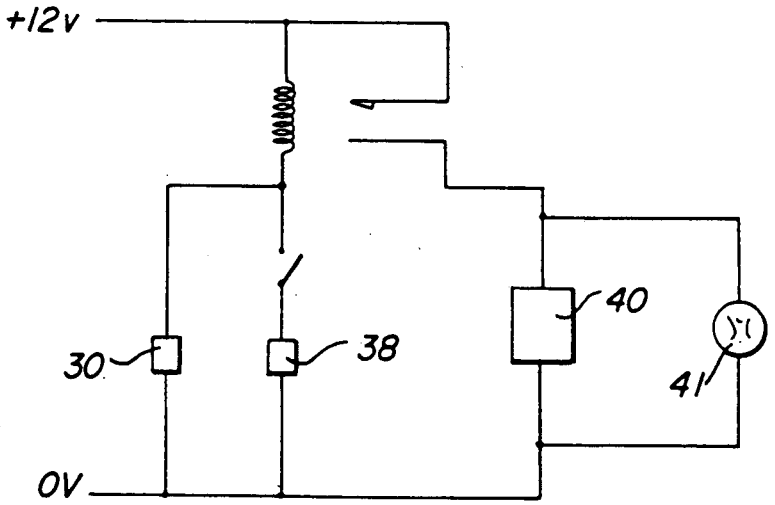
FIG. 5

DOORSTAYS

BACKGROUND OF THE INVENTION

This invention relates to door stays for use as security devices for the purpose of restricting unauthorised entry through a door to which it is fitted. Presently, many attacks on elderly or other defenseless persons living along are being experienced. Such attacks often occur in the home by an assailant forcing open the door after the person has opened it to enquire the caller's business. Also, attacks in the home are being experienced by able-bodied persons in the evenings or during the early hours of the mornings while they are resting.

Heretofore, security devices have been provided for such purposes, however they have suffered from the disadvantage that either they do not permit the door to be slightly opened to allow the inhabitant to enquire the business of the visitor, or if they do, the device does not withstand substantial force being applied against it. One example of the latter type is a security chain in which, with enough force, the screws securing the chain keeper to the door post or frame can be pulled out, therefore rendering the security device useless An object of the present invention is to provide a doorstay for use as a security device which will obviate or mitigate the aforesaid disadvantage.

Accordingly, the present invention is a doorstay comprising a stay having a determined length retraction, the stay being pivotally mountable at one end to a first bracket to be secured to a surface against which the door is opened, and at the other end locatable into a second bracket to be secured on the inside of the door.

Preferably, the second bracket has an open passage terminating in a blind bore, the other end of the stay intended to rest on the wall of the open passage but enter the bore on opening of the door to which the stay and second bracket are fitted.

Preferably also, the stay allows two predetermined short amount of movements, a first free movement followed by a movement against biasing. The biasing is preferably resilient.

Preferably further, an attention attracting means is provided including warning means with an electrical circuit having a contact switch and a reset switch, together with a power supply, with the contact switch operating with retractible movement of the stay. The circuit is preferably housed in a casing with the reset switch mounted on the outside of a removable front lid. The power supply is preferably batteries which are housed in the casing. The warning means may be either audible or visual or both.

BRIEF DESCRIPTION OF THE DRAWINGS

An embodiment of the present invention will now be described, by way of example, with reference to the accompanying drawings, in which:

FIG. 4 is an exploded perspective view of the doorstay;

FIG. 5 is an electric circuit block diagram for operation of warning means of the doorstay.

DETAILED DESCRIPTION OF THE PREFERRED EMBODIMENT

Figure 1:
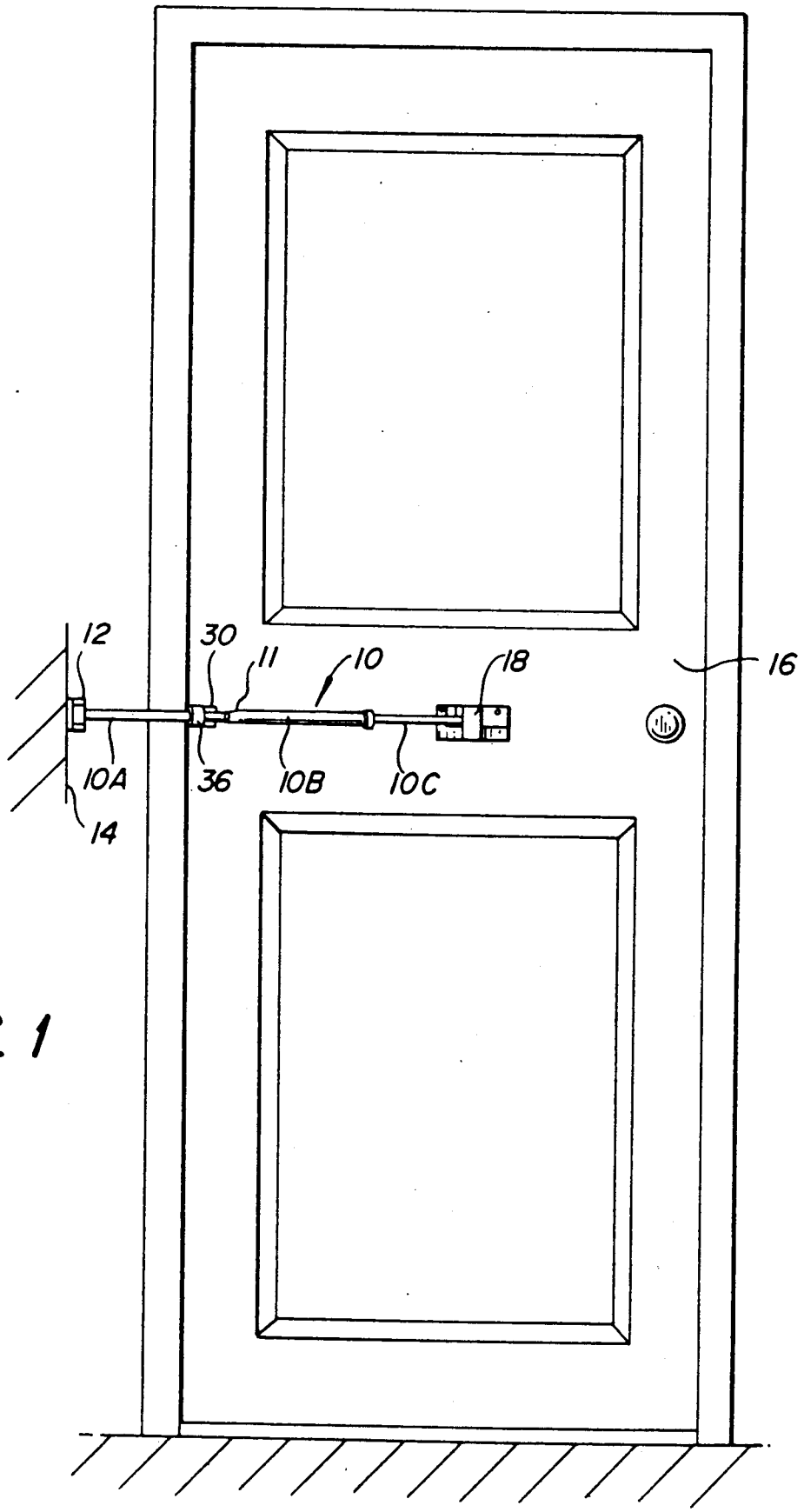
FIG. 1 is a front elevation of the inside of a doorway having a door with a doorstay according to the present invention fitted thereto.
Figure 2:
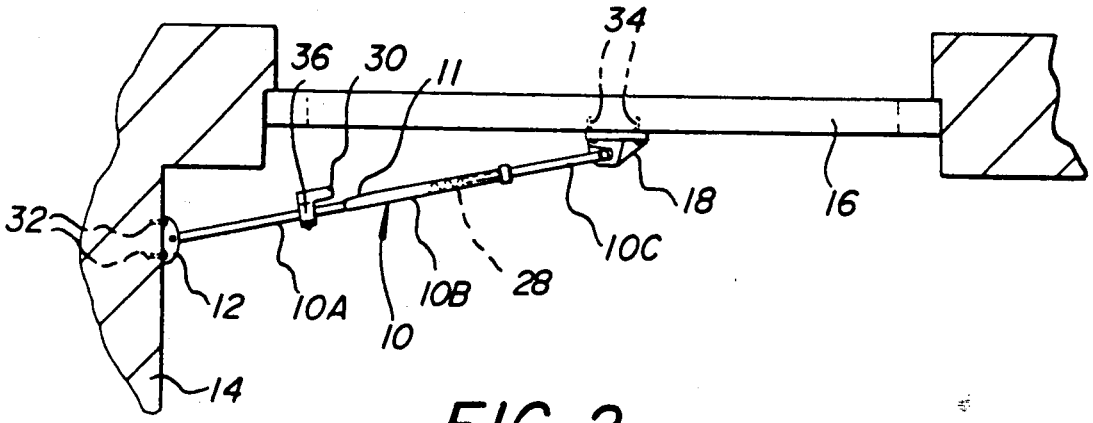
FIG. 2 is a plan view of the view shown in FIG. 1.

Referring to the drawings, a doorstay is shown in FIGS. 1 and 2 fitted between a door 16 and a surface ie. a wall 14. The doorstay comprises a length retractible stay 10 formed by two members 10A, 10B in telescopic relationship. The stay 10 is pivotally mountable by pin 9 at one end (referred to in the following as the distal end of member 10A to a first bracket 12 to be secured to the wall 14 against which the door 16 is to be opened. One end of member 10B distal from member 10A of the stay 10 is locatable into a second bracket 18 to be secured on the inside of the door 16. Member 10B at its distal end has an extension 10C which engages the second bracket 18. The extension 10C is connected to the member 10B through an external screw thread on the former engaging an internal screw thread in the latter. This screw threaded engagement enables a length extension or length retraction to be obtained in the stray 10 when the stay is first fitted to the door 16 and wall 14.

Figure 3:
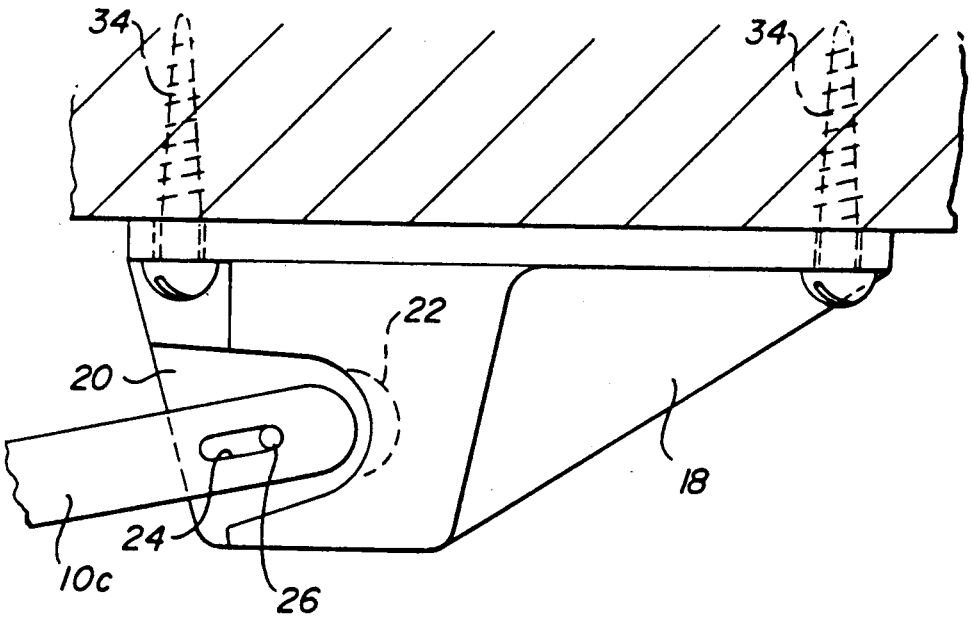
FIG. 3 is a enlarged plan view of a second bracket.

The second bracket 18 has an open-topped passage 20 terminating at its inner end in a blind bore 22, FIG. 3. The other end 10B of the stay 10 is intended to rest on the bottom wall of the open-topped passage 20. The other end 10B of the stay 10 is provided with a slot 24 which is to engage over an upright pin 26 projecting from the bottom wall of the passage 20. The other end 10B only enters the bore 22 on opening of the door 16.

The stay 10 has two predetermined short amounts of retractible movements, a first free movement followed by a movement against biasing. The biasing is resilient and is formed by a helical spring 28, or other suitable substitute such as a cylinder block of rubber or of resilient synthetic material. The spring 28 is positioned internally of member 10B between its distal end and the internal end of member 10A as shown in FIG. 2.

An attention attracting means is provided comprising warning means, and an electrical circuit as shown in block diagram in FIG. 5. The circuit has a buttom reset switch 38 and a contact switch 30 (FIGS. 1, 2, 4 and 5), the contact switch 30 being in the form of a micro-switch, mounted in a support 36 positioned on member 10A a determined distance from the member 10B. The warning means is audible, such as a horn or klaxon 40 but can be visual (not shown), for example a lamp 41 or can be both audible and visual. The switch 30 operates with sliding movement of the stay when fitted between a position when the door is closed and a position when the door is forced beyond the full extent of the free movement between members 10A, 10B. The wall of the end of member 10B, into which member 10A slides is tapered at 11 to operate the micro-switch 30 on sliding movement, i.e. the advance of the tapered end of the member 10B brings a portion of the tapered end against the micro-switch 30 so as to operate the microswitch 30. A power supply in the form of batteries is provided. The circuit and power supply are housed in a casing 42 with the reset button switch 38 mounted on the front of a removable lid 42A.

A doorstay above-described is fitted between the door 16 and wall 14 by first securing with fastenings 32 the first bracket 12 to the wall 14. Then at the same height from the ground as bracket 12 is mounted, the second bracket 18 is secured to the door with screw fastenings 34. The stay 10 is then located with the distal end of extension 10C lying on the bottom wall of passage 20. If the stay 10 is too long or too short, length adjustment is made as required by screw adjustment between the extension 10C and the distal end of member 10B. The casing 42 is mounted on the adjacent wall 14 and the warning means is also wall mounted.

The doorstay is only used when the occupier is in the house otherwise the stray 10 is disengaged from the second bracket 18. In use, the stray 10 is fitted with the distal end of the extension lying on the bottom wall of the passage 20. When the door is rapped or a doorbell rings, the door 16 can be opened a distance equal to the amount of movement between the distal end of the extension and the blind end of bore 22 plus the amount of free movement between the members 10A, 10B. The occupier can talk to the caller through the opening. Depending on who the caller is or what his/her business is, the occupier will decide to allow the caller into the house or will close the door. To open the door 16, it has first to be shut, extension 10C removed from the second bracket 18 and the door opened again. If, however, the occupier does not want to let the caller in, and he/she pushes continually at the door, the stay will move against the biasing and no further. If the caller pushes or kicks against the door sharply but not continually, the biasing will tend to spring the door back to shut it In a first modification of the embodiment shown in FIG. 6, the second bracket 18 is provided with two passages 20, 20' and respective blind bores 22, 22' in opposite directions to each other whereby to enable the second bracket to be used right-handedly or left-handedly.

In a second modification, the slot 24 in member 10B can be omitted with the corresponding upright pin 26 also omitted.

Variations and other modifications can be made without departing from the scope of the invention as above described.

We claim:

1. A doorstay comprising a stray having a determined length retraction, the stray being pivotally mounted at one end to a first bracket secured to a surface against which a door is opened, and at the other end located on a second bracket which is secured to an inside surface of the door, said second bracket having an open passage terminating in a blind bore, the other end of the stray rests on a wall of the open passage and enters the bore on opening of the door to which the stay and second bracket are mounted.

2. A doorstay as claimed in claim 1, wherein the stay allows two predetermined short amount of movement, a first free movement followed by a movement against biasing.

3. A doorstay as claimed in claim 2, wherein the biasing is resilient.

4. A doorstay as claimed in claim 3, wherein the biasing is a helical spring or rubber block.

5. A doorstay as claimed in any one of claims 1, 2 or 3, wherein the attention attracting means is provided including warning means with an electrical circuit having a contact switch and a reset switch, together with a power supply, with the contact switch operating with retractible movement of the stay.

6. A doorstay as claimed in claim 5, wherein the circuit is housed in a casing with the reset switch mounted on the outside of a removable front lid.

7. A doorstay as claimed in claim 5, wherein the power supply is batteries which are housed in the casing.

8. A doorstay as claimed in claim 5 wherein the warning means is either audible or visual, or both audible and visual.

9. A doorstay as claimed in claim 6 wherein the power supply is batteries which are housed in the casing.

10. A doorstay as recited in claim 6, wherein the warning means is either audible or visual, or both audible and visual.

11. A doorstay as recited in claim 7, wherein the warning means is either audible or visual, or both audible and visual.

* * * * *

UNITED STATES PATENT AND TRADEMARK OFFICE

CERTIFICATE OF CORRECTION

PATENT NO. : 5,039,147

DATED : August 13, 1991

INVENTOR(S) : Alan Moon et al

It is certified that error appears in the above-identified patent and that said Letters Patent is hereby corrected as shown below:

ON THE TITLE PAGE

Item [75] Inventors: after "Moon", insert --34 Marmount Gardens, Belfast, Northern Ireland, BT14 6NW--.

Figure 6:
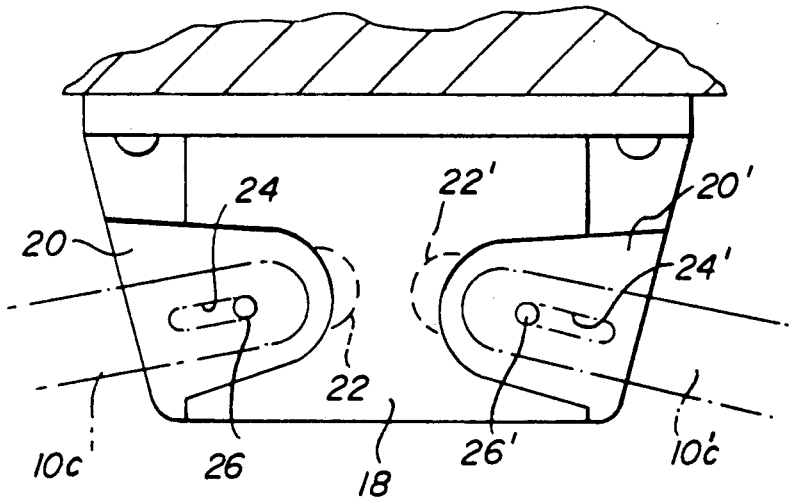
FIG. 6 is an enlarged plan view of the second bracket of FIG. 3, as modified.
Figure 6A:
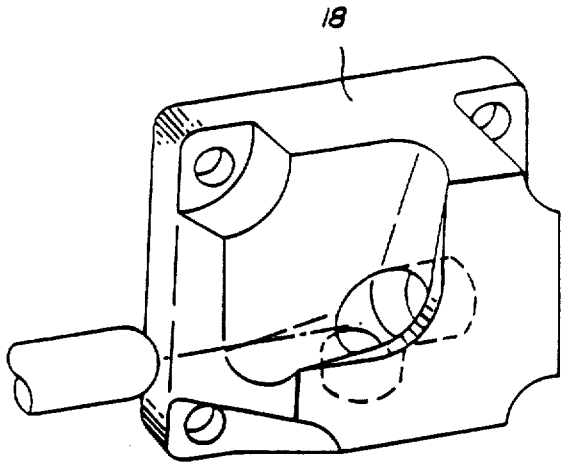
Figure 6B:
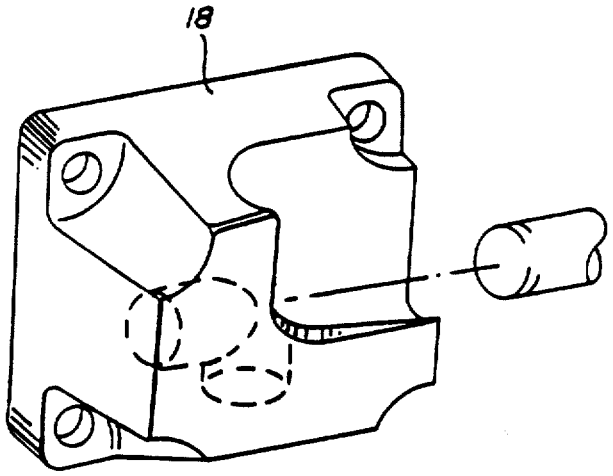

On the drawing sheet 4 of 4, delete Fig. 6, and insert new Fig. 6(A) and 6(B), as shown on the attached page.

UNITED STATES PATENT AND TRADEMARK OFFICE

CERTIFICATE OF CORRECTION

PATENT NO. : 5,039,147

DATED : August 13, 1991

INVENTOR(S) : Alan Moon et al

It is certified that error appears in the above-identified patent and that said Letters Patent is hereby corrected as shown below:

Column 2, delete lines 1 and 2 in their entirety, and insert therefor -- Figs. 6(A) and 6(B) are enlarged perspective views of the embodiment of the second bracket shown in Fig. 4, illustrating two passages and respective blind bores at right angles to each other. --

Column 3, lines 29 and 30, delete "22, 22' in opposite directions", and insert therefor -- at right angles --.

Signed and Sealed this

Twenty-first Day of January, 1992

*Attest:*

*Attesting Officer*

HARRY F. MANBECK, JR.

*Commissioner of Patents and Trademarks*